United States Patent [19]

Larsen

[11] 4,319,719

[45] Mar. 16, 1982

[54] SHELL LINER ASSEMBLY FOR ORE GRINDING MILLS

[75] Inventor: Darrell R. Larsen, Salt Lake City, Utah

[73] Assignee: Minneapolis Electric Steel Castings Company, Minneapolis, Minn.

[21] Appl. No.: 115,940

[22] Filed: Jan. 28, 1980

Related U.S. Application Data

[63] Continuation-in-part of Ser. No. 79,382, Sep. 27, 1979, Pat. No. 4,270,705, which is a continuation-in-part of Ser. No. 932,711, Aug. 11, 1978, Pat. No. 4,235,386.

[51] Int. Cl.[3] ..... B02C 17/22

[52] U.S. Cl. ..... 241/183; 241/299; 241/DIG. 30

[58] Field of Search ..... 241/182, 183, 284, 299, 241/300, DIG. 30

[56] References Cited

U.S. PATENT DOCUMENTS

| | | | |
|---|---|---|---|
| 887,575 | 5/1908 | Barry | 241/182 |
| 1,055,395 | 3/1913 | Globe | 241/183 |
| 1,128,901 | 2/1915 | Posselt | 241/183 |
| 1,207,174 | 12/1916 | Johnson | 241/183 |
| 1,295,289 | 2/1919 | Fasting | 241/183 |
| 1,315,025 | 9/1919 | Lawler | 241/183 |
| 1,470,420 | 10/1923 | Askin et al. | 241/183 |
| 1,534,000 | 4/1925 | Baker | 241/183 |
| 1,807,034 | 5/1931 | Hardinge | 241/183 |
| 1,872,036 | 8/1932 | Hardinge | 241/183 |
| 1,947,505 | 2/1934 | Van Pelt | 241/183 |
| 2,216,784 | 10/1940 | Payne | 241/182 |
| 2,456,266 | 12/1948 | Gates | 241/183 X |
| 3,065,920 | 11/1962 | Johnson et al. | 241/294 |
| 3,404,846 | 10/1968 | MacPherson et al. | 241/183 X |
| 3,462,090 | 8/1969 | Landes et al. | 241/299 |
| 3,582,007 | 6/1971 | Heighberger | 241/183 |
| 3,630,459 | 12/1971 | Siegten | 241/183 |
| 3,680,799 | 8/1972 | Hallerback | 241/183 |
| 3,701,487 | 10/1972 | Quesnel et al. | 241/182 X |
| 3,804,346 | 4/1974 | Norman | 241/182 |
| 3,949,943 | 4/1976 | Schuler et al. | 241/183 |
| 4,018,393 | 4/1977 | Larsen | 241/182 |
| 4,046,326 | 9/1977 | Larsen | 241/182 |
| 4,165,041 | 8/1979 | Larsen | 241/182 |

FOREIGN PATENT DOCUMENTS

| | | |
|---|---|---|
| 1131489 | 6/1962 | Fed. Rep. of Germany . |
| 2305311 | 8/1974 | Fed. Rep. of Germany . |
| 42-4388 | 3/1967 | Japan . |
| 8619 | of 1914 | United Kingdom . |

OTHER PUBLICATIONS

"Mechanized Replacement of Large Mill Liners at Climax", Hinken, W. R. & Dunn, D. J., *Mining Congress Journal,* 10/1971, pp. 36–41.

Dunn, D. J., "Build a Better Mill Liner", *Mining Year Book,* 1973, pp. 29–30.

*Primary Examiner*—Mark Rosenbaum

*Attorney, Agent, or Firm*—Merchant, Gould, Smith, Edell, Welter & Schmidt

[57] ABSTRACT

The disclosure is directed to an improved liner assembly for an ore grinding mill. The liner assembly is of the segmented type, comprising a first plurality of holder segments which are mounted directly to the shell of the mill, and a second plurality of wear segments which are mounted to the shell in overlying relation to the holder segments, which are thus virtually unexposed to the ore comminution process and wear very slowly. The wear segments are formed with a plurality of downwardly projecting bosses which are received in similarly configured recesses formed within the holder segments. Mounting openings or bores are formed in the wear segments, extending from the top grinding surface to the center of each boss to receive a mounting bolt that extends through both segments and projects externally of the shell to receive a threaded lock nut. These mounting openings are countersunk so that the heads of the mounting bolts securing the wear segments are substantially recessed from the grinding surface. The holder segments are secured directly to the shell by identical mounting bolts through mounting openings which are protectively covered by the wear segments to preclude exposure to the ore fragments during the comminution process.

17 Claims, 5 Drawing Figures

SHELL LINER ASSEMBLY FOR ORE GRINDING MILLS

This is a continuation-in-part of my copending application filed on Sept. 27, 1979, under Ser. No. 079,382 entitled "Shellliner Assembly for Ore Grinding Mills", now U.S. Pat. No. 4,270,705, which is a continuation-in-part of my copending application filed on Aug. 11, 1978 under Ser. No. 932,711 of the same title, now U.S. Pat. No. 4,235,386.

The invention relates generally to apparatus for comminuting ore, and is specifically directed to an improved liner assembly for an ore grinding mill used in commercial mining operations.

Grinding mills of this type may employ rods or balls to assist in the comminuting process as the mill is rotated, or the ore may be self-grinding in large automatic mills. An example of the latter type mill consists of a large cylindrical drum mounted on bearings for rotation about a substantially horizontal axis and driven by a powerful motor through conventional reduction gearing. The axial ends of the drum are open, and the material to be comminuted is continuously fed into the mill at one end with the comminuted product continuously emerging from the other end.

From the economic standpoint, it is important to keep any type of ore grinding mill in operation as continuously as possible, keeping the downtime for maintenance or repair to a minimum. However, many ores (e.g., taconite) are extremely hard and highly abrasive, and in order to maintain continuous operation of the grinding mill it is necessary to provide a liner for the drum which is highly abrasion resistant, and also tough enough to withstand the continuous impact of the ore fragments.

Due to size and weight considerations, liner assemblies for ore grinding mills of this type are typically segmented; i.e., they comprise a plurality of separate components that are individually secured to the drum of shell of the mill. My earlier U.S. Pat. No. 4,018,393 is directed to liner segments which are formed with sockets of a special shape and disposed at predetermined intervals, and which are held within the cylindrical shell by bolts having heads received in the sockets and threaded shanks passing through the liner segments and the mill shell to receive nuts at the outer surface. The sockets and heads are shaped to provide continuous flat contact areas of substantial size regardless of variations in center distances of holes axially along the shell.

This particular approach to securing the segment and liners to the shell has represented a significant improvement due to previous difficulties in obtaining registration of bolt holes in the segments and shell, and continuous flush engagement of contiguous surfaces. However, as was recognized in my later issued U.S. Pat. No. 4,046,326, the structural configuration of liner segments is necessarily complex, and does not lend itself to fabrication from materials which are highly abrasion resistant. Examples of ideal materials for this use are martensitic white iron or martensitic steel, both of which are extremely abrasion resistant. However, since materials such as these undergo a significant volume change as they pass from the austenitic stage to martensitic form, it is extremely difficult to form from such materials an article of significant size or complex configuration since the transformation from martensite, as the result of rapid cooling, may crack the article and render it useless in an ore crushing operation. Thus, prior to the invention disclosed and claimed in U.S. Pat. No. 4,046,326, segmented liners were usually made from a "tough" material which offered relatively good resistance to impact, although its resistance to abrasion was somewhat lower. My later patent was, therefore, directed to a liner assembly in which the primary structure of each liner segment is made from a "tough" material, coupled with the use of one or more inserts formed from highly abrasion resistant material in a manner such that the insert or inserts represent primary exposure to the ore fragments but are always retained, even if they break due to brittleness. This is accomplished through the formation of an opening extending entirely through the liner assembly, and which has tapered sides converging toward the exposed surface. The inserts are of conforming shape and size, having similar converging sides which engage and wedge against those of the segment opening. The inserts are placed into the segment opening from its back or unexposed side, projecting through to the exposed surface but being retained in this position by the wedging action. As the liner segment is bolted to the shell, the inserts are positively and rigidly retained, capable of comminuting the ore, but incapable of escape. With such an assembly, the inserts can be made in fairly simple configurations, to overcome the fabrication problem mentioned above, and thus enabling the benefits of abrasion resistant materials.

Ser. Nos. 932,711 and 079,382 are both directed to an improved liner assembly for ore grinding mills which simplifies replacement of the assembly while at the same time preserving the substantial benefit derived from the use of abrasion-resistant inserts. These improved assemblies comprise a plurality of holder segments formed from tough, impact-resistant material which are fastened directly to the shell in a conventional manner. The assemblies further comprise a second plurality of liner segments formed from abrasion resistant material which "cap" the holder segments and are uniquely connected directly thereto without any mounting connection to the shell itself.

In the liner assemblies disclosed in Ser. Nos. 932,711 and 079,382, provision is made for protecting the means for fastening the abrasion resistant caps to the holder segments from ore fragments so that, even if the liner is substantially worn, there is less difficulty in removing the abrasion resistant caps.

Provision is also made in these liner assemblies for protecting the means for fastening the holder segments to the shell from damage by ore fragments, which permits easier replacement of the holder segments as this becomes necessary. More specifically, the holder segments are provided with transverse mounting openings through which bolts extend, projecting outwardly of the shell to receive the threaded nuts. These mounted openings are positioned so that the abrasion resistant wear caps protectively overlie the mounting openings of the holder segments as well as the mounting bolts which they receive.

However, in the liner assemblies of both Ser. Nos. 932,711 and 079,382, the holder segments are exposed in part to ore fragments and wear during the comminution process. Since the holder segments are formed from material having a lesser resistance to abrasion than that of the wear caps, wear occurs in these exposed areas and replacement eventually becomes necessary, albeit less frequently than the rate of replacement of the wear caps.

The invention of this application is thus directed to an improved liner assembly for ore grinding mills of the segmented type comprising a plurality of holder segments and a plurality of wear segments, the holder and wear segments being uniquely configured so that the former is protectively covered by the latter substantially in its entirety. State otherwise, the holder segments are substantially unexposed to the ore comminution process, and, to the extent that wear of the liner is properly monitored, the holder segments do not become worn at all.

An additional advantage is that the wear segments, in protectively overlying the holder segments, also protectively overlie the means for mounting the holder segments to the shell, so that replacement of the holder segments, when this eventually becomes necessary, is simplified because there is no damage to the holder segment or its mounting means during the comminution process.

This composite approach to the segmented liner assembly is significant and advantageous for several reasons. First, the lower or holder segment can be formed from material which does not have high resistance to abrasion or high impact resistance. Because it is not exposed, its sole function is to support the upper or wear element. To the extent that it does not become exposed to the comminution process, which is accomplished by careful monitoring of the wear of the upper segments, the lower or holder segments will last through several replacements of the wear segments.

The fact that the holder segments can be made from material of lesser wear characteristics is a significant advantage both with respect to weight and economy. The material of the upper wear segments preferably exhibits high resistance to abrasion, examples of which are martensitic white iron or steel. These materials are not only much heavier, but also significantly more costly. Consequently, the substitution of a lesser material in this inventive structural combination does not impair performance, but effects both a reduction in weight and in cost.

As pointed out abvove, it is difficult to cast articles from abrasion resistant material which are of significant size or complex configuration. Further, it is difficult to manufacture such products with any degree of close tolerance, and obviously, a product which is highly abrasion resistant does not lend itself to machining. However, it is important for the holder and wear segments to fit together reasonably well so that forces of impact are distributed and withstood uniformly. This is particularly difficult where the area of interface between the holder and wear segments is significant in size. In view of this, the preferred embodiment of the inventive liner assembly includes a layer of rubberized fabric or the functional equivalent thereof. The resilient nature of this layer covers imperfections in the castings and is therefore a significant advantage to the foundry. In addition, the layer assists in distributing forces of impact, and it is easily replaceable. Lastly, it serves as a visual indicator to the mill operator that replacement of the wear segments is necessary when the layer can be seen.

The interconnection between the holder and wear segments is also unique through the provision of a plurality of lugs or bosses projecting downward from the wear segments, and similarly configured recesses in the holder segments. These bosses project through the entire thickness of the holder segment and approach contact with the drum surface itself. Mounting openings are formed transversely through the wear segments in the center of the bosses. Because of this structural configuration, the head of each mounting bolt used to secure the wear segments to the shell are oriented much more closely to the inner shell surface, which means that the wear segment can be worn down to a greater degree without damaging the mounting bolts and loosening the wear segments. This also leads to greater time between liner assembly changes and economic savings in the overall operation.

Additional features and advantages will be appreciated from the accompanying drawings and specification.

DESCRIPTION OF THE PREFERRED EMBODIMENT

FIGS. 1–5 disclose a segmented liner assembly according to the invention and adapted for use with a cylindrical drum or shell 11 of an ore grinding machine. The ore grinding machine may be of the type disclosed in U.S. Pat. No. 4,046,326, in which the hollow cylindrical drum or shell 11 is constructed and arranged for rotation about a substantially horizontal axis. The drum or shell 11 is substantially closed by axial end walls with the exception of central axial openings through which the ore is respectively supplied and discharged.

Figure 1:
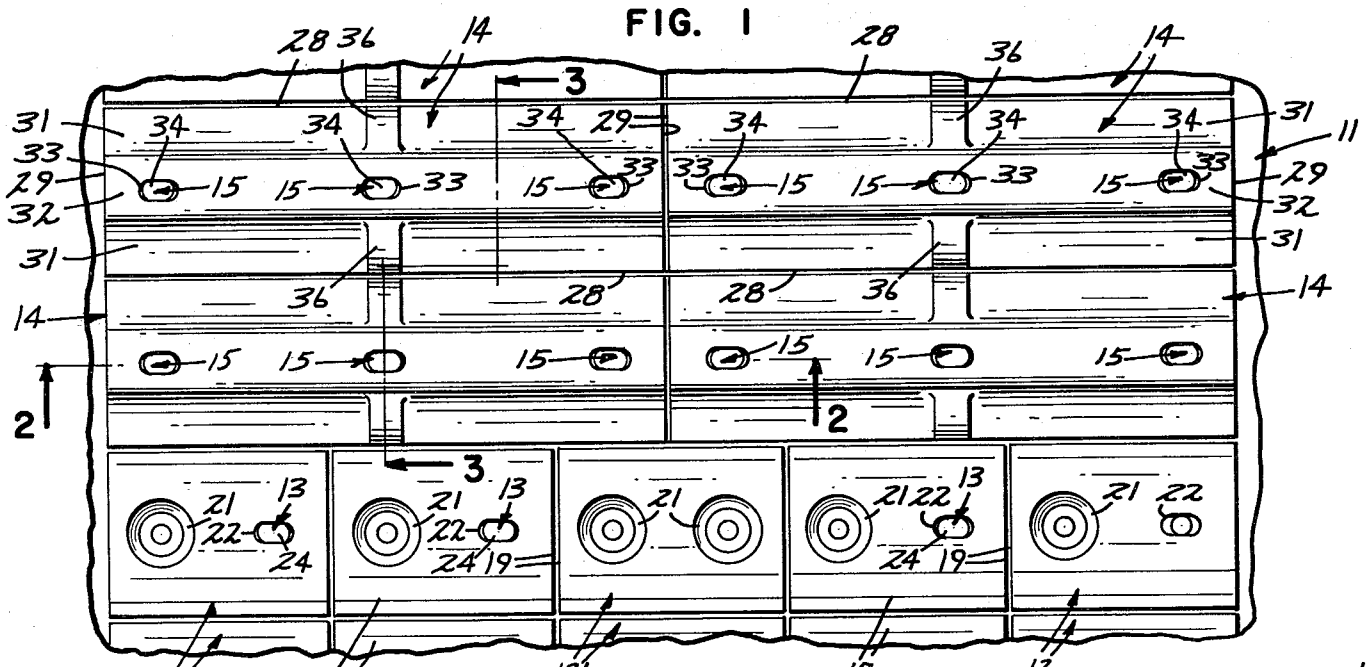
FIG. 1 is a fragmentary plan view of a segmented liner assembly for an ore grinding mill according to the invention, and viewed radially outward from within the mill.
Figure 2:
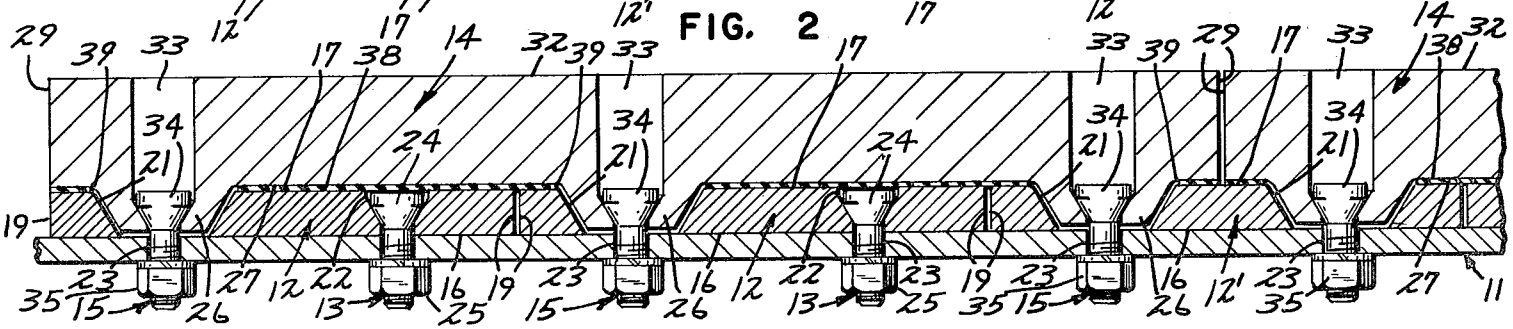
FIG. 2 is a fragmentary sectional view of the liner assembly taken along the line 2—2 of FIG. 1.
Figure 3:
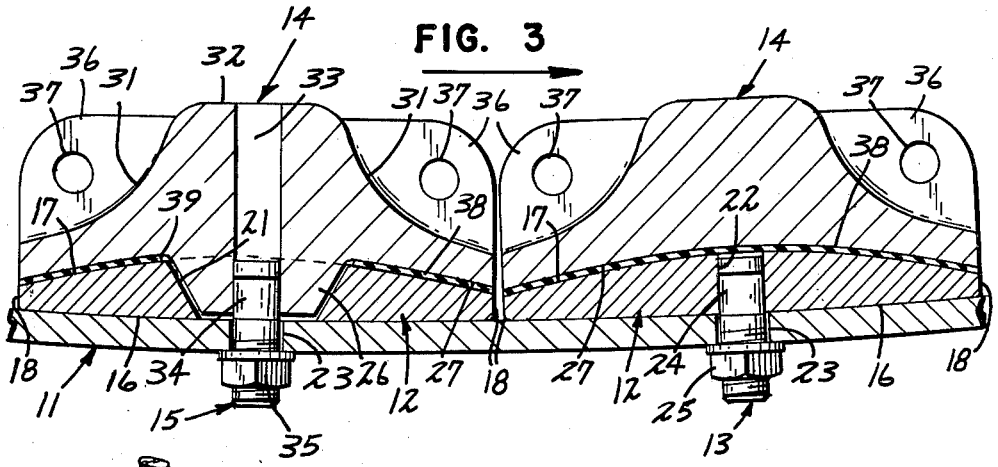
FIG. 3 is an enlarged fragmentary transverse sectional view of the liner assembly taken along the line 3—3 of FIG. 1.
Figure 4:
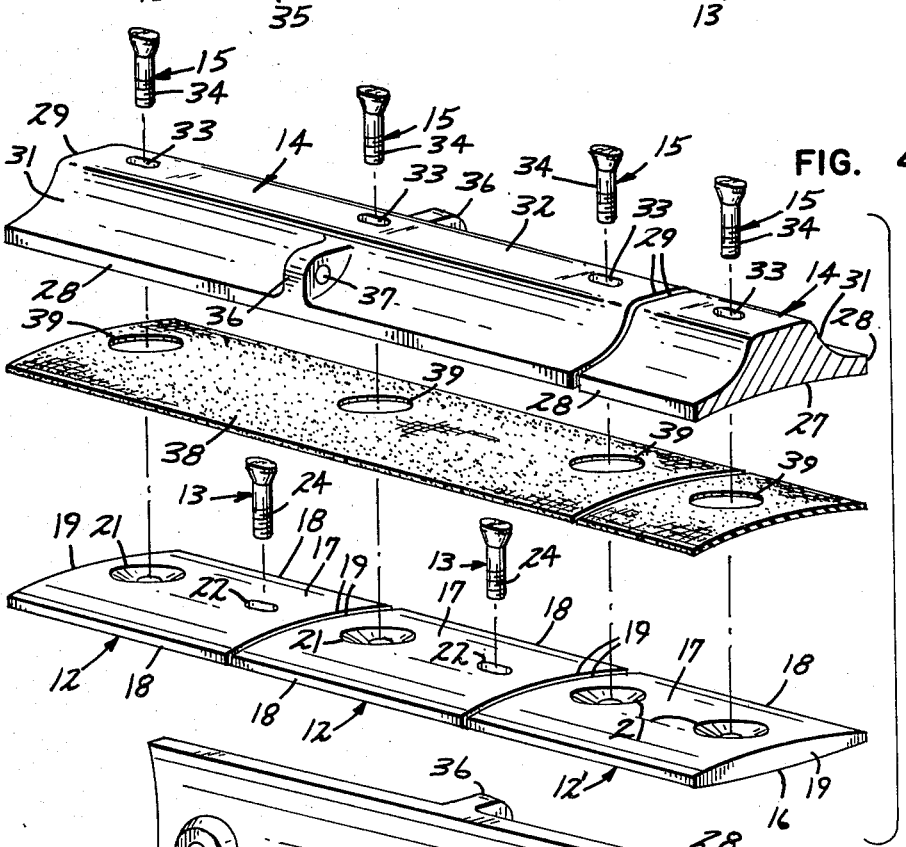
FIG. 4 is an exploded perspective view of the liner assembly components as viewed from the front side and one end thereof.
Figure 5:
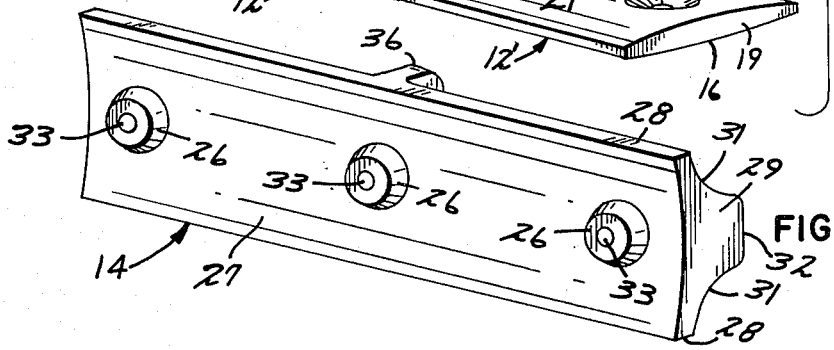
FIG. 5 is a perspective view of a wear segment component of the liner assembly viewed from the bottom and one end thereof.

With specific reference to FIG. 3, the liner assembly comprises a plurality of holder segments 12 fastened directly to the shell 11 by first fastening means 13, and a plurality of wear segments 14 which are secured to the shell 11 by second fastening means 15. As shown in FIGS. 1, 2 and 4, both the holder segments 12 and wear segments 14 are elongated in shape, but in the preferred embodiment five holder segments 12 are provided for two of the wear segments 14. These relative lengths are chosen as a matter of convenience in manufacture and installation, and other relative lengths, including equivalent lengths, will function as well.

As shown in FIG. 1, the segments 12, 14 are arranged in a plurality of rows which are substantially parallel with the axis of rotation of the shell 11, the rows being disposed in close proximity to substantially cover the inner cylindrical surface of shell 11. The shell 11 is rotated in the direction indicated in FIG. 3, and since the liner assembly defines a plurality of axially extending ridges, ore fragments are carried upward with rotation of the drum and then tumble downward in a comminuting manner.

With reference to FIGS. 2 and 4, it will be seen that two structural configurations of the holder segments 12 are provided, and these different configurations bear the reference numerals 12 and 12', respectively. This is necessary because five of the holder segments are provided for two of the wear segments, and also due to the spacing of mounting openings within the holder segments 14, as will be described below. The sole structural difference between the holder segments 12, 12' resides in the type of mounting openings, as is particularly apparent in FIG. 4, and also as described below.

With reference to FIG. 4, each of the holder segments 12, 12' defines a slightly arcuate or convex mounting surface 16 which conforms to the inner cylindrical surface of the shell 11. The top surface of the holder segments 12, 12', which bears the reference numeral 17, is also convex, but as best shown in FIG. 3, the radius of curvature of the surface 17 is somewhat less than the surface 16, and the curvature itself is therefore more pronounced. Each of the holder segments defines identical flat sides 18 which, as shown in FIG. 3, substantially lie on radii of the shell 11, and identical flat ends 19, which are substantially mutually parallel.

With reference to FIGS. 1–4, each of the holder segments 12 includes two different mounting openings 21, 22 which are disposed along the longitudinal axis thereof in predetermined spaced relation. Each of the holder segments 12' includes two mounting openings 21, also spaced along the segment longitudinal axis.

The spacing of the mounting openings 21, 22 within the holder segments 12, 12' is determined as a function of the spacing between the circumferential rows of mounting openings formed in the cylindrical shell 11, which bear reference numeral 23 in FIGS. 2 and 3. Typically, these circumferential rows of mounting openings 23 are spaced twelve inches apart in a cylindrical shell 11 having a length of ten feet and a diameter of 32 feet. Accordingly, the spacing between the mounting openings 21, 22 within the holder segments 12, 12' is uniform, and this spacial distance is the same between any mounting opening 21, 22 and the mounting opening in the next adjacent holder segment 12 or 12'.

As viewed in the top plan of FIG. 1 and the perspective view of FIG. 4, each of the mounting openings 22 is oblong in configuration at the convex surface 17. As viewed in the longitudinal sectional view of FIG. 2, each of the mounting openings 22 defines a first pair of angular side walls that incline or converge from the top surface 17 to the bottom surface 16. As viewed in the transverse sectional view of FIG. 3, each of the mounting openings 22 defines a second pair of flat, mutually parallel side walls.

As constructed, the mounting openings 22 are adapted to receive the fastening means 13, each of which specifically comprises a threaded bolt 24 having a generally oblong head with one pair of tapered sides which round into a pair of parallel sides. This configuration enables the bolt 14 to center itself within the mounting opening 22, and to clamp the holder segment 12 against the inner surface of drum 11 by the wedging relation between the bolt head and mounting opening 22. This is specifically accomplished by a lock nut 25 which threads onto the bolts 24 externally of the shell 11, as shown in FIG. 3.

With reference to FIGS. 1–3, each of the mounting openings 21 is substantially larger than the mounting openings 22. Each mounting opening 21 extends entirely through the holder segment 12 and takes the shape of an inverted frustum of a cone.

As configured, each of the mounting openings 21 is adapted to receive one of a plurality of frustoconical bosses 26 which project downwardly from the bottom surface 27 of wear segments 14. As best shown in FIGS. 2 and 3, the bosses 26 are slightly smaller than the mounting openings 21, and the resulting spacing therebetween avoids any problem of abnormal tolerance. Because of potential difficulties in obtaining registration of the bosses 26 within the mounting openings 21 relative to the shell mounting openings 23, it is preferred that this fit be loose enough to permit adjustable movement.

The bottom surface 27 of each of the wear segments 14 otherwise generally conforms to the top surface 17 of holder segments 12, and is thus convex as viewed in the transverse sectional view of FIG. 3.

Each of the wear segments 14 is also formed with identical flat sides 28 which are coplanar with the sides 18 of holder segments 12 when assembled (FIG. 3). As shown in FIG. 1, each of the wear segments 14 is formed with identical flat ends 29 which are substantially mutually parallel.

The top or grinding surface of each of the wear segments 14 is symmetrical in transverse section (FIG. 3), comprising a pair of opposed concave surfaces 31 that curve upward from the sides 28 to a top flat surface 32. With the wear segments mounted in end-to-end relation within an axial row, the top surfaces 32 together define an axial ridge which runs virtually the entire length of the shell or drum 11. Since the holder segments are also disposed in side-by-side relation, as shown in FIG. 1, it will be seen that a plurality of axial ridges are disposed circumferentially around the inner surface of the drum, with alternating recesses or valleys as defined by the concave surfaces 31.

This ridged inner surface causes the ore fragments to be carried upward as the drum 11 rotates, and comminution results from the tumbling action as the fragments fall back on one another.

As best understood from FIG. 3, rotation of the drum 11 in one direction causes wear of the wear segments 14 on one side more than the other. The symmetrical cross section of the wear segments 14 means that the drum 11 may be rotated in the opposite direction to obtain maximum wear time, and it also permits the wear segments 14 to be mounted in either end-to-end direction.

Mounting is accomplished by a plurality of mounting openings 33, which are disposed in alignment with the bosses 26 and extend entirely through the wear segment 14 from the top surface 32 to the bottom of the bosses 26. As shown in FIGS. 2 and 3, mounting openings 33 are substantially the same as mounting openings 22 of the holder segments 12, with the exception that they are countersunk a much greater distance than the mounting openings 22.

The fastening means 15 are identical to the fastening means 13, comprising a bolt 34 having a tapered head and a lock nut 35 that threads onto the projecting bolt externally of the shell 11. The depth of the countersink of mounting opening 33 enables the head of bolt 34 to be deeply recessed from the top surface 32. Consequently, substantially the entire thickness of the wear segments 14, excluding the projecting dimension of the bosses 26, may be worn away without exposing the bolt 34 to wear, thus optimizing wear life of the wear segments 14.

The mounting openings 33 and bosses 26 are spaced along the longitudinal axis of wear segments 14 for registration with the mounting openings 21 and 23, respectively. The structural configuration not only enables the wear segments 14 to wear longer, but also assists significantly in obtaining alignment of the wear segments on the underlying holder segments, 12' during installation of the liner assembly.

Installation is facilitated by the integral casting of a large ear 36 (FIG. 3), projecting from each of the concave surfaces 31 at the longitudinal midpoint of the wear segments 14. The ears 36 are formed with large apertures 37, permitting the wear segments 14 to be lifted into place.

In the preferred embodiment, a layer 38 of rubberized fabric is disposed between the holder segments 12 and wear segments 14 so that these components fit snugly together without the need for close tolerance casting or machining. The rubberized fabric layer 38 causes impact forces to be distributed evenly over the entire convex surface of the holder segments 12, 12'.

The layer 38 is rectangular in shape, conforming in size to the undersurface 27 of wear segment 14. Apertures 39 are punched through the layer 38 to register with the mounting openings 21.

In addition to the convenience which the layer 38 offers to the foundry by covering imperfections in the casting, the rubberized fabric layer also provides a visual indication that operators of the apparatus can see as the wear segments 14 wear down. As shown as the rubberized fabric 38 may be seen, the wear segments 14 should be replaced.

The preferred material from which the layer 38 is made is rubberized fabric, although other materials could be used so long as the layer 38 is adaptive or resilient.

In installation of the inventive liner assembly, the holder segments 12 are first mounted by placement of the segments relative to the mounting openings 23 in axial rows. Although holder segments 12 have but a single mounting opening 22, they are retained in place by the engagement of adjacent ends 19. The same holds true for the holder segments 12', which are held temporarily in place by the adjacent holder segments 12 until the wear segments 14 are placed in position and bolted by the fastening means 15. The rubberized fabric layer 38 is placed over the holder segments 12 before the wear segments 14 are introduced, and they are replaced with the wear segments 14 when necessary.

Because the holder segments, 12' are covered substantially in their entirety by the wear segments 14 and rubberized fabric layers 38, wear is much less significant, and it is intended that the holder segments, 12' remain in place and be reused for several changes of the wear segments 14. This effects a significant saving because installation of the entire assembly is avoided, coupled with the fact that the cost of the holder segments 12, 12' may be significantly less than the wear segments 14 because a softer, less expensive material may be used.

What is claimed is:

1. A liner assembly for the cylindrical shell of an ore grinding machine comprising:

(a) a plurality of first liner segments of predetermined size and configuration, each defining a bottom mounting surface constructed for mounting engagement with the inner surface of the cylindrical shall, and each of said first liner segments further defining a top mounting surface;

(b) said first liner segments being disposed in close proximity to each other with minimum space therebetween so that said plurality of first liner segments covers virtually the entirety of said cylindrical shell;

(c) a plurality of second liner segments of predetermined size and configuration, each of said second liner segments defining a bottom mounting surface constructed for mounting engagement with the top mounting surface of an associated first liner segment, each second liner segment further defining a top grinding surface for comminuting ore;

(d) said second liner segments being disposed in close proximity to each other with minimum space therebetween, and being sized relative to the first liner segments so that, in assembled relation, the first liner segments are substantially covered by the second liner segments and virtually unexposed to the ore comminution process to prevent the first liner segments from becoming worn;

(e) first connecting means for releasably mounting a portion of the first liner segments to the cylindrical shell independently of the second liner segments;

(f) and second connecting means for releasably mounting each of the second liner segments on an associated one of said first liner segments to permit removal thereof without removing the associated first liner segments from the cylindrical shell;

(g) the first and second liner segments being so constructed that the second liner segments completely and protectively cover the first connecting means with the liner assembly in assembled relation.

2. The liner assembly defined by claim 1, wherein each of the first liner segments includes a plurality of mounting openings formed transversely therethrough, and the first connecting means comprises a plurality of mounting bolts extending through the mounting openings for mounting the first liner segments directly to the cylindrical shell.

3. The liner assembly defined by claim 1 or 2, wherein:

(a) each of said second liner segments has at least one mounting opening formed transversely therethrough;

(b) each of said first liner segments has at least one mounting opening formed transversely therethrough disposed for registration with a mounting opening of an associated second liner segment;

(c) and the second connecting means comprises a plurality of mounting bolts extending through the registered mounting openings for mounting the first and second liner segments to the shell.

4. The liner assembly defined by claim 3, wherein the mounting openings of the second liner segments are countersunk to permit the heads of the mounting bolts to be recessed substantially from said grinding surface.

5. The liner assembly defined by claim 4, wherein:

(a) each of the second liner segments comprises a plurality of bosses projecting downward from the bottom mounting surface thereof;

(b) and each mounting opening of the first liner segment comprises a recess generally conforming to the shape of the bosses and disposed for registration therewith;

(c) the mounting openings of the second liner segments extending transversely through the bosses and being countersunk within the bosses to substantially recess the heads of the mounting bolts from said grinding surface.

6. The liner assembly defined by claim 5, wherein the bosses are frustoconical in configuration.

7. The liner assembly defined by claim 1, wherein the mounting surfaces of the first and second liner segments are concavo-convex.

8. The liner assembly defined by claim 7, wherein the top mounting surface of each of the first liner segments is convex.

9. The liner assembly defined by claim 1, which further comprises a layer of adaptive material disposed between the mounting surfaces of the first and second liner segments.

10. The liner assembly defined by claim 9, wherein the layer of adaptive material is rubberized fabric.

11. The liner assembly defined by claim 10, wherein the mounting surfaces of the first and second liner segments are concavo-convex.

12. The liner assembly defined in claim 1, wherein each of said second liner segments is formed from material that has a greater resistance to abrasion than the material of said first liner segments.

13. The liner assembly defined by claim 12, wherein the material of said second liner segments is martensitic white iron.

14. The liner assembly defined by claim 12, wherein the material of said second liner segments is martensitic steel.

15. A liner assembly for the cylindrical shell of an ore grinding machine, comprising:

(a) a plurality of first liner segments of predetermined size and configuration, each defining a bottom mounting surface constructed for mounting engagement with the inner surface of the cylindrical shell, and each of said first liner segments further defining a top mounting surface;

(b) a plurality of second liner segments of predetermined size and configuration, each of said second liner segments defining a bottom mounting surface constructed for mounting engagement with the top mounting surface of an associated first liner segment, each second liner segment further defining a top grinding surface for comminuting the ore;

(c) each of said second liner segments further comprising a plurality of bosses extending downward from the bottom mounting surface thereof, and a mounting opening extending through the segment from the grinding surface to the center of each boss;

(d) each of said first liner segments further comprising a mounting opening extending transversely therethrough, each mounting opening disposed to receive one of the bosses in conforming shape thereto;

(e) each mounting opening of the second liner segment being countersunk within the associated boss, whereby mounting bolts may be used to secure the first and second liner segments to the shell with the heads thereof substantially recessed from the grinding surface;

(f) and said second liner segments being sized relative to the first liner segment so that, in assembled relation, the first liner segments are substantially covered by the second liner segments and virtually unexposed to the ore comminution process to prevent the first liner segments from becoming worn.

16. The liner assembly defined by claim 15, wherein the bosses are frustoconical in configuration.

17. A liner assembly for the cylindrical shell of an ore grinding machine comprising:

(a) a plurality of first liner segments of predetermined size and configuration, each defining a bottom mounting surface constructed for mounting engagement with the inner surface of the cylindrical shell and a top mounting surface, and each of said first liner segments including a plurality of mounting openings formed transversely therethrough;

(b) a plurality of second liner segments of predetermined size and configuration, each of said second liner segments defining a bottom mounting surface constructed for mounting engagement with the top mounting surface of an associated first liner segment, each second liner segment further defining a top grinding surface for comminuting ore;

(c) first connecting means comprising a plurality of mounting bolts extending through said mounting openings for mounting the first liner segments directly to the cylindrical shell of the ore grinding machine independently of said second liner segments;

(d) and second connecting means for mounting each of the second liner segments on an associated one of said first liner segments, said second connecting means constructed and arranged to permit removal of a second liner segment from the associated first liner segment without removing the associated first liner segment from the cylindrical shell;

(e) the first and second liner segments being so constructed that the first liner segments, said mounting openings and mounting bolts are protectively covered by the second liner segments in assembled relation and virtually unexposed to the ore comminution process.

* * * * *

UNITED STATES PATENT AND TRADEMARK OFFICE

CERTIFICATE OF CORRECTION

PATENT NO. : 4,319,719

DATED : March 16, 1982

INVENTOR(S) : Darrell R. Larsen

It is certified that error appears in the above—identified patent and that said Letters Patent is hereby corrected as shown below:

Column 7, line 4, "holder segments, 12'" should be changed to --holder segments 12, 12'--.

Column 7, line 47, "holder segments, 12'" should be changed to --holder segments 12, 12'--.

Column 7, line 50, "holder segments, 12'" should be changed to --holder segments 12, 12'--.

Signed and Sealed this

Fifth Day of April 1983

[SEAL]

*Attest:*

GERALD J. MOSSINGHOFF

*Attesting Officer*

*Commissioner of Patents and Trademarks*